US006508543B2

(12) United States Patent
Hawkins et al.

(10) Patent No.: US 6,508,543 B2
(45) Date of Patent: Jan. 21, 2003

(54) CONTINUOUS INK JET PRINTHEAD AND METHOD OF TRANSLATING INK DROPS

(75) Inventors: Gilbert A. Hawkins, Mendon, NY (US); David L. Jeanmaire, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/777,426

(22) Filed: Feb. 6, 2001

(65) Prior Publication Data

US 2002/0105561 A1 Aug. 8, 2002

(51) Int. Cl.[7] ..... B41J 2/09; B41J 2/105
(52) U.S. Cl. ..... 347/77; 347/82
(58) Field of Search ..... 347/73, 77, 82, 347/40

(56) References Cited

U.S. PATENT DOCUMENTS 3,709,432 A * 1/1973 Robertson ..... 239/4
4,054,882 A 10/1977 Ruscitto
4,068,241 A * 1/1978 Yamada ..... 347/75
4,520,366 A 5/1985 Cragin, Jr.

FOREIGN PATENT DOCUMENTS

EP 0 911 161 A3 4/1999
EP 0 911 161 A2 4/1999

* cited by examiner

*Primary Examiner*—Thinh Nguyen
(74) *Attorney, Agent, or Firm*—William R. Zimmerli

(57) ABSTRACT

A continuous ink jet apparatus is provided. The printhead includes a nozzle array with portions of the nozzle array defining a length dimension. A drop forming mechanism is positioned relative to the nozzle array. The drop forming mechanism is operable in a first state to form ink drops having a first volume travelling along a path and in a second state to form ink drops having a second volume travelling along the path. A system applies force to the ink drops travelling along the path. The force is applied in a direction such that the ink drops having the first volume diverge from the path and at least one of the ink drops having the first volume and the ink drops having the second volume are displaced relative to the length dimension.

40 Claims, 12 Drawing Sheets

CONTINUOUS INK JET PRINTHEAD AND METHOD OF TRANSLATING INK DROPS

CROSS REFERENCE TO RELATED APPLICATIONS

Reference is made to commonly assigned, co-pending U.S. Ser. No. 09/750,946, entitled Printhead Having Gas Flow Ink Droplet Separation And Method Of Diverging Ink Droplets, filed in the names of Jeanmaire and Chwalek on Dec. 28, 2000; co-pending U.S. Ser. No. 09/751,232, entitled A Continuous Ink-Jet Printing Method And Apparatus, filed in the names of Jeanmaire and Chwalek on Dec. 28, 2000; and U.S. Ser. No. 09/777,461, entitled A Continuous Ink Jet Print Head and Method of Rotating Ink Drops, filed in the names of Hawkins and Jeanmaire, concurrently herewith.

FIELD OF THE INVENTION

This invention relates generally to the design and fabrication of inkjet printheads, and in particular to printheads configured to uniformly translate the position of printed ink drops on a receiver without altering the position of the printhead with respect to the receiver.

BACKGROUND OF THE INVENTION

Traditionally, digitally controlled inkjet printing capability is accomplished by one of two technologies. The first technology, commonly referred to as "drop-on-demand", ejects ink drops from nozzles formed in a printhead only when an ink drop is desired to impinge on a receiver. The second technology, commonly referred to as "continuous", ejects ink drops from nozzles formed in a printhead continuously with ink drops being captured by a gutter when ink drops are not desired to impinge on a receiver.

Referring to FIG. 1, a printhead 120 typically includes an approximately linear row of nozzles 122 which define printhead length 124 (measured in a direction along the nozzle row). Printhead 120 is scanned across a stationary receiver 126 in a fast scan direction 128. After fast scan 128 is complete, receiver 126 is moved in a receiver motion direction 130 relative to printhead 120. Typically, receiver motion 130 is orthogonal or substantially orthogonal to fast scan direction 128 and receiver 126 is moved in receiver motion 130 rather than displacing printhead 120 in a slow scan direction 132. Printhead 120 is subsequently scanned again in fast scan direction 128 with nozzles 122 having been physically displaced with respect to receiver 126 by an incremental amount (shown schematically so as to be easily compared to printhead length 124). The overall result is displacement of printhead 120 is in slow scan direction 132. Typically, displacement of printhead 120 with respect to receiver 126 in slow scan direction 132 is a fraction of nozzle to nozzle spacing 134. Typically, slow scan direction 132 is also orthogonal or substantially orthogonal to fast scan direction 128. Alternatively, printhead 120 can be physically stepped in slow scan direction 132 in order to physically displace printhead 120 with respect to receiver 126. Receiver 126 can also be moved in slow scan direction 132 in order to accomplish displacement of printhead 120 with respect to receiver 126. In either situation, either printhead 120 or receiver 126 is moved. Typically, the above-described motions are controlled by a controller 134. Many commercially available desktop printers (drop-on-demand printers, etc.) operate in this manner.

In continuous inkjet printers, receiver 126 is typically moved in fast scan direction 128 rather than printhead 120 because of the size and complexity of printhead 120. In many cases, printhead length 124 is pagewide and extends across the entire width of receiver 126 with fast scan direction 128 of receiver 126 being perpendicular to printhead length 124. This type of printhead and/or printer is commonly referred to as a "pagewidth" printhead/printer. Alternatively, printhead 120 can be scanned in fast scan direction 128, then stepped in slow scan direction 132 before printhead 120 scanned again in fast scan direction 128.

In some continuous printing applications, it is desirable to move printhead 120 in slow scan direction 132 in order to translate the pattern of printed ink drops (with respect to receiver 126) produced by nozzles 122. For example, in several conventional pagewidth printers, printhead 120 is translated or dithered a small distance from side to side in a direction parallel to its length (slow scan direction 132). This motion can be used to compensate for irregularities in nozzle to nozzle spacing 134 of printhead 120. Typical nozzle to nozzle spacing 134 is a multiple of the desired distance between printed dots. As such, printhead 120 can be displaced slightly along its length and fast scan 128 is repeated one or more times in order to print all desired dots. Typically, translated printed drop patterns are created by translating printhead 120 in slow scan direction 132 with respect to receiver 126. However, receiver 126 can be translated or displaced in slow scan direction 132 while printhead 120 remains stationary in slow scan direction 132.

Translation of the printhead in the slow scan direction is very precise. As such, commercially available mechanical devices that perform this task increase overall printer costs, are complex, and are prone to failure. Additionally, commercially available printheads often perform poorly when translated or dithered rapidly due to fluid acceleration along the length of the printhead. This is particularly true for pagewidth printheads because pagewidth printheads have extremely long fluid channels, typically distributed over the entire length of the printhead. Rapidly displacing the printhead intensifies the adverse affects of the fluid acceleration. As such, there is a need for an improved printhead translatable along its length (typically, in the slow scan direction relative to the receiver).

Additionally, it is advantageous to adjust the location of ink drop patterns printed on a receiver in the slow-scan direction in order to improve image quality. In this regard, displacing, dithering, or translating the printhead by an integral spacing relative to nozzle to nozzle spacing (the distance between nozzles) allows selected nozzles to print different data, thereby reducing image artifacts. The printhead motion (translation) needs to occur quickly in order to accomplish this. Typically, this motion is completed in a time much shorter in duration than the time required to scan in the fast scan direction. Again, currently available mechanical devices that accomplish this motion increase system cost and complexity. As such, there is a need for an improved printhead capable of adjusting the location of ink drop pattern printed on a receiver.

It is also advantageous to adjust the location of ink drop patterns printed on a receiver so as to slightly change the angle of the printhead relative to the fast scan direction in order to suppress image artifacts. This situation typically arises, for example, when the angle of the receiver changes while passing under the printhead. In many of these situations, changing the angle of the printhead relative to the fast scan direction needs to occur rapidly in order to prevent printed ink drops from misregistering (being printed on the wrong location) on the receiver. Again, currently available mechanical devices for moving the printhead at an angle relative to the fast scan direction add expense and complexity. Additionally, these devices can interfere with printhead performance during printhead motion in the fast scan direction due to the additional weight of the devices. As such, there is a need for an improved printhead capable of changing the angle of drops printed from a row of nozzles.

SUMMARY OF THE INVENTION

An object of the present invention is to provide an improved printhead translatable along its length.

Another object of the present invention is to provide an improved printhead rapidly translatable along its length that accurately and rapidly produces displaced printed drops in a direction parallel to the length of the printhead without interfering with the performance of the printhead.

Another object of the present invention is to provide an improved printhead capable of rapidly rotating the pattern of printed ink drops through an angle with respect to the receiver.

Yet another object of the present invention is to produce a displaced pattern of ink drops printed on a receiver without having to displace the receiver or the printhead.

Yet another object of the present invention is to provide an improved printhead having reduced cost and increased reliability.

According to a feature of the present invention, a continuous ink jet printing apparatus includes a nozzle array with portions of the nozzle array defining a length dimension. A drop forming mechanism is positioned relative to the nozzle array. The drop forming mechanism is operable in a first state to form ink drops having a first volume travelling along a path and in a second state to form ink drops having a second volume travelling along the path. A system applies force to the ink drops travelling along the path. The force is applied in a direction such that the ink drops having the first volume diverge from the path with the ink drops having the first volume being displaced relative to each other along the length dimension.

According to another feature of the present invention, a method of translating ink drops ejected from a continuous ink jet printhead includes forming a first ink drop having a first volume travelling along a path; forming a first ink drop having a second volume travelling along the path; causing the first ink drop having the first volume to diverge from the path; forming a second ink drop having the first volume travelling along the path; forming a second ink drop having the second volume travelling along the path; and causing the second ink drop having the first volume to diverge from the path displaced relative to the first ink drop having the first volume.

According to another feature of the present invention, a method of translating ink drops includes forming a first ink drop having a first volume travelling along a path; causing the first ink drop having the first volume to diverge from the path; forming a second ink drop having the first volume travelling along the path; and causing the second ink drop having the first volume to diverge from the path displaced relative to the first ink drop having the first volume.

According to another feature of the present invention, a continuous ink jet printing apparatus includes a nozzle array. A drop forming mechanism is positioned relative to the nozzle array with the drop forming mechanism being operable to form a first ink drop travelling along a path and a second ink drop travelling along the path. A system which applies force to the first and second ink drops travelling along the path, the force being applied in a direction such that the first and second ink drops diverge from the path, at least a portion of the system being moveable between a first position relative to the nozzle array and a second position relative to the nozzle array such that the second ink drop is displaced relative to the first ink drop as the second ink drop diverges from the path.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 2A:
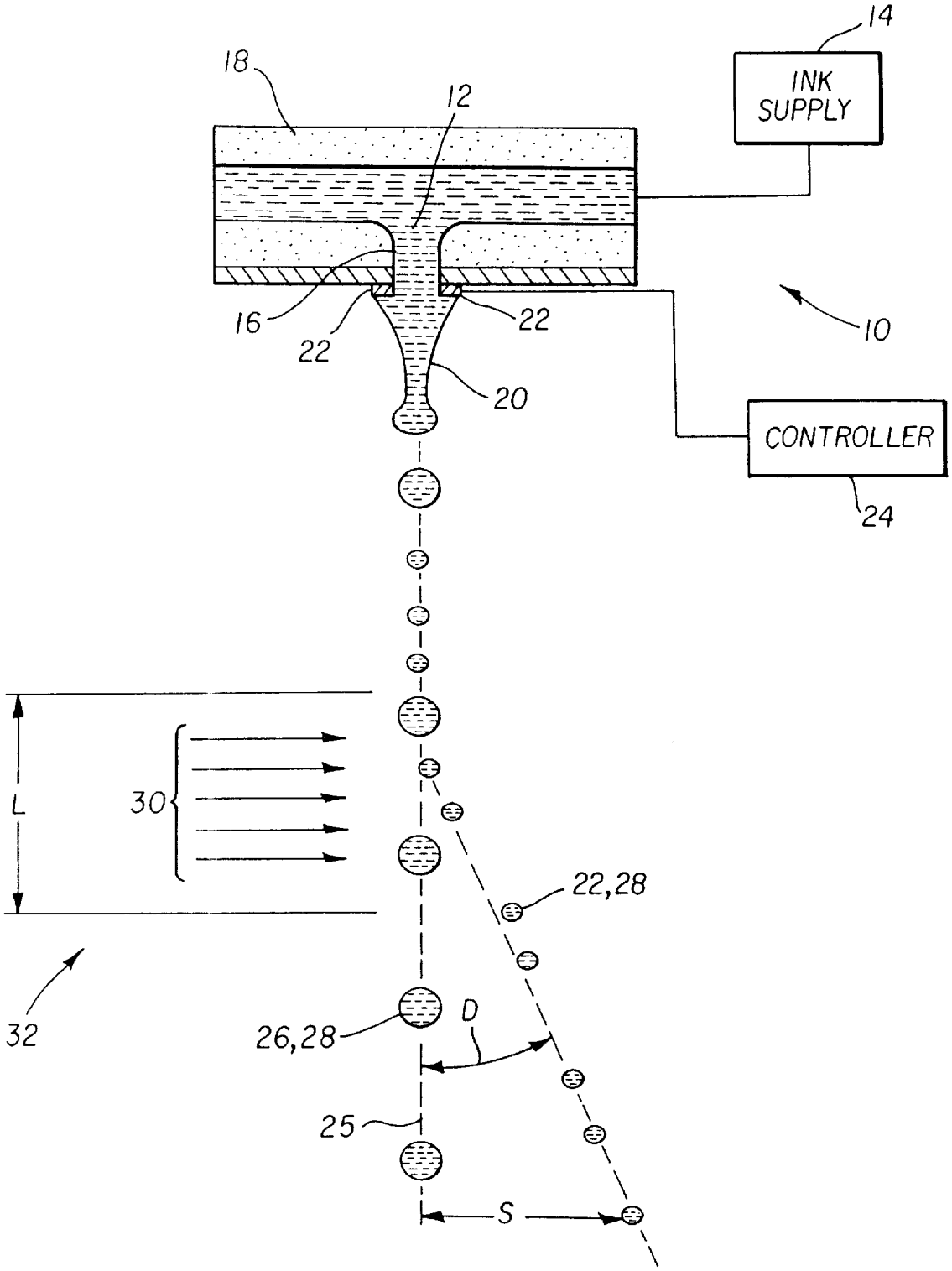
FIGS. 2*a*–2*c* show schematic cross-sectional views of an apparatus incorporating the present invention.
Figure 2B:
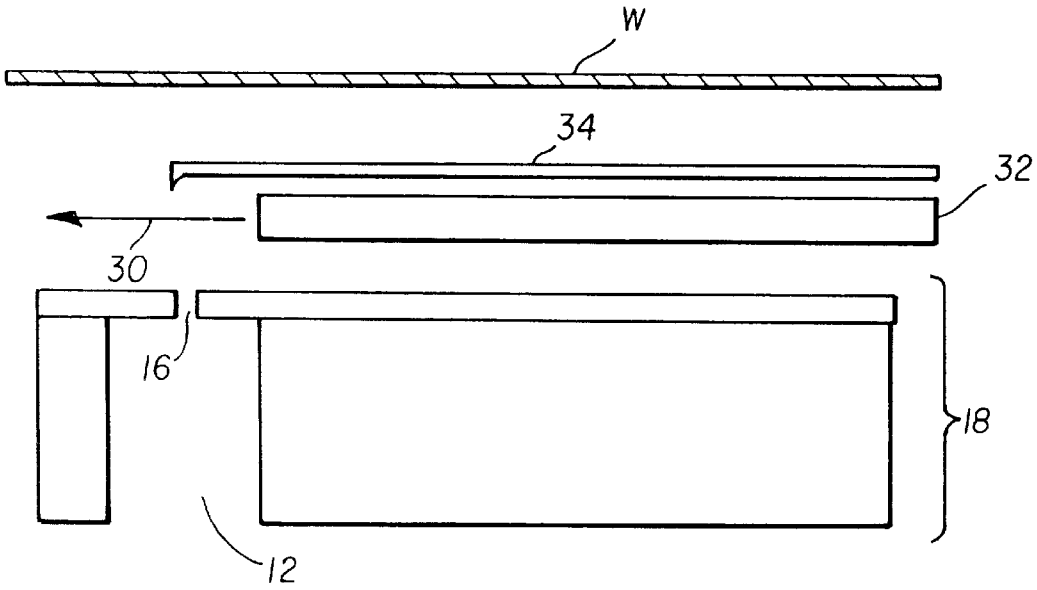
Figure 2C:
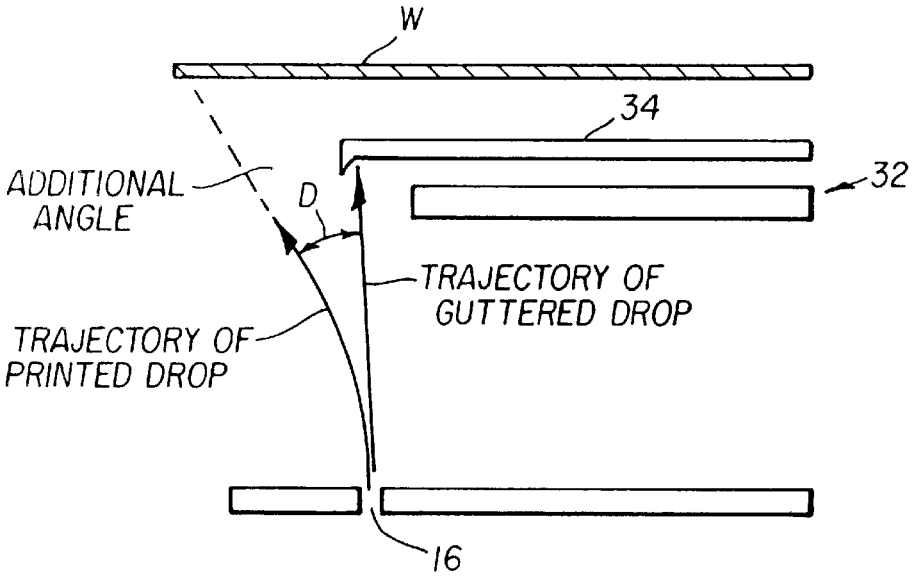

Referring to FIGS. 2*a*–2*c*, an apparatus 10 incorporating the present invention is schematically shown. Although apparatus 10 is illustrated schematically and not to scale for the sake of clarity, one of ordinary skill in the art will be able to readily determine the specific size and interconnections of the elements of the preferred embodiment. Pressurized ink 12 from an ink supply 14 is ejected through nozzles 16 of printhead 18 creating filaments of working fluid 20. Typically, nozzles 16 are formed in a membrane of printhead 18 overlying an ink cavity formed in printhead 18. Ink drop forming mechanism 22 (for example, a heater, piezoelectric actuator, etc.) is selectively activated at various frequencies causing filaments of working fluid 20 to break up into a stream of selected ink drops (one of 26 and 28) and non-selected ink drops (the other of 26 and 28) with each ink drop 26, 28 having a volume and a mass. The volume and mass of each ink drop 26, 28 depends on the frequency of activation of ink drop forming mechanism 22 by a controller 24.

A force 30 from ink drop deflector system 32 interacts with ink drop stream 25 deflecting (through angle D) ink drops 26, 28 depending on each drops volume and mass. Accordingly, force 30 can be adjusted to permit selected ink drops 26 (large volume drops) to strike a receiver W while non-selected ink drops 28 (small volume drops) are deflected, shown generally by deflection angle D, into a gutter 34 and recycled for subsequent use. Alternatively, apparatus 10 can be configured to allow selected ink drops 28 (small volume drops) to strike receiver W while non-selected ink drops 26 (large volume drops) strike gutter 34. System 32 can includes a positive pressure source or a negative pressure source. Force 30 is typically positioned at an angle relative to ink drop stream 25 and can be a positive or negative gas flow. The gas can be air, nitrogen, etc.

Figure 3A:
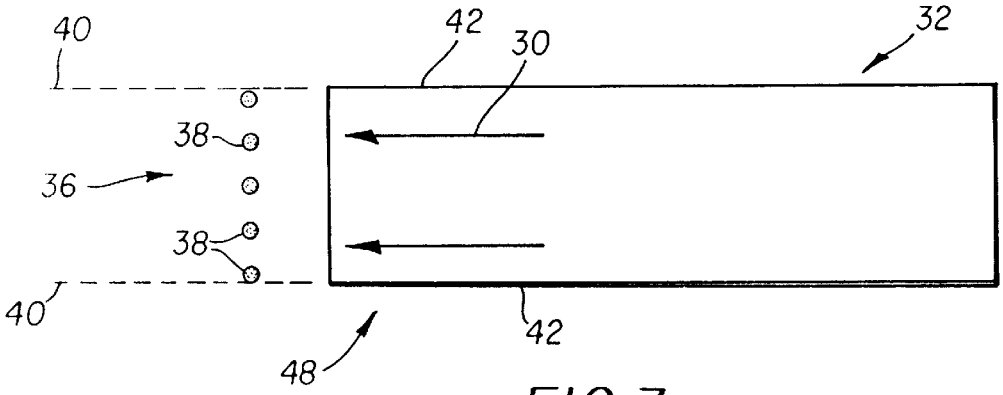
FIGS. 3*a*–3*c* show a schematic top view of a portion of the apparatus of FIG. 2*a* and resulting printed ink drop patterns.
Figure 3B:
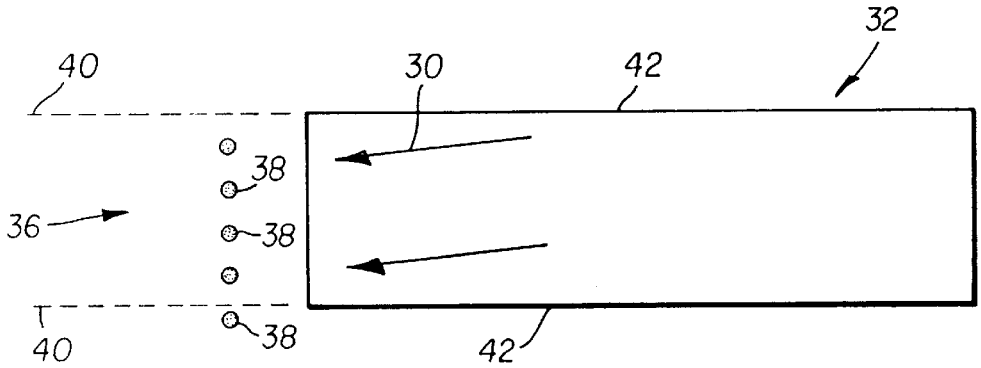
Figure 3C:
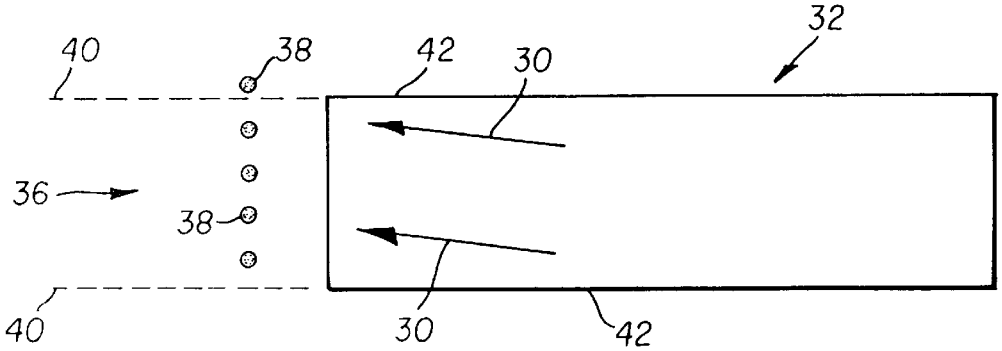

Referring to FIGS. 3*a*–3*c*, a schematic top view of deflection system 32 and a resulting pattern 36 of printed ink drops 38 printed on a receiver is shown. Fiducial lines 40 represent displacement of printed drops in slow scan direction from reference points. In FIG. 3*a*, the reference points are edges 42 of system 32 with at least a portion of system 32 being positioned substantially parallel to nozzle row and the direction of force 30 being perpendicular to ink drops ejected from nozzle 16. Alternatively, force 30 can be altered in a first altered direction (as shown in FIG. 3*b*) such that printed drops are displaced with respect to fiducial lines 42 (downward in FIG. 3*b*). Force 30 can also be altered in a second altered direction (as shown in FIG. 3*c*) such that printed drops are displaced with respect to fiducial lines 42 (upward in FIG. 3*c*).

Figure 4A:
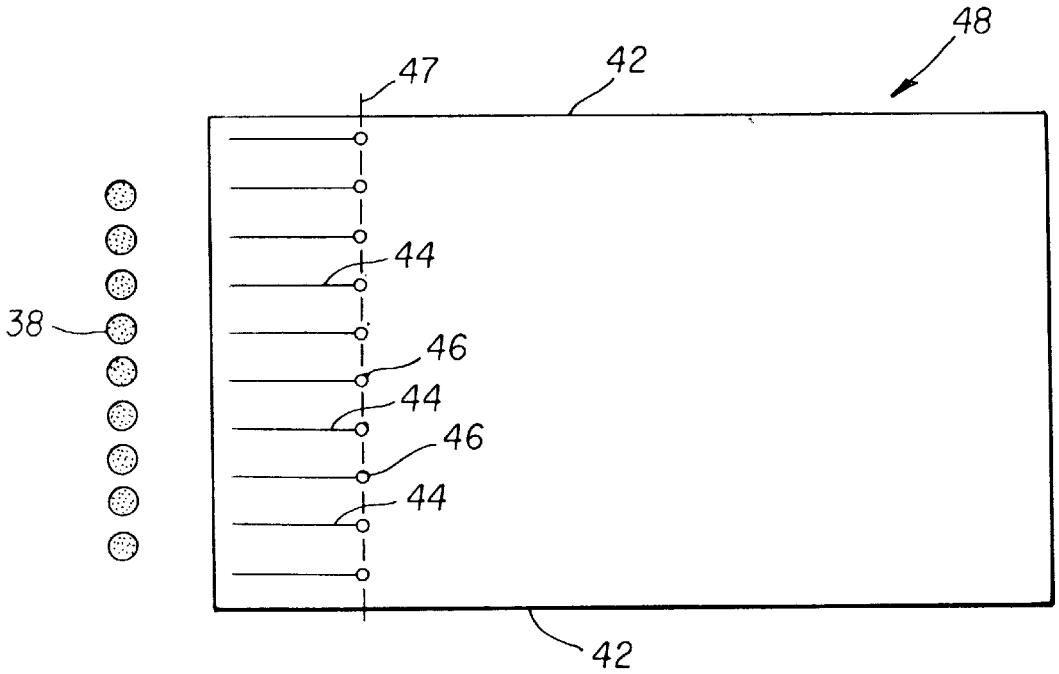
FIGS. 4*a* and 4*b* show schematic top views of the portion of the apparatus of FIGS. 3*a*–3*c* made in accordance with the present invention and resulting printed ink drop patterns.
Figure 4B:
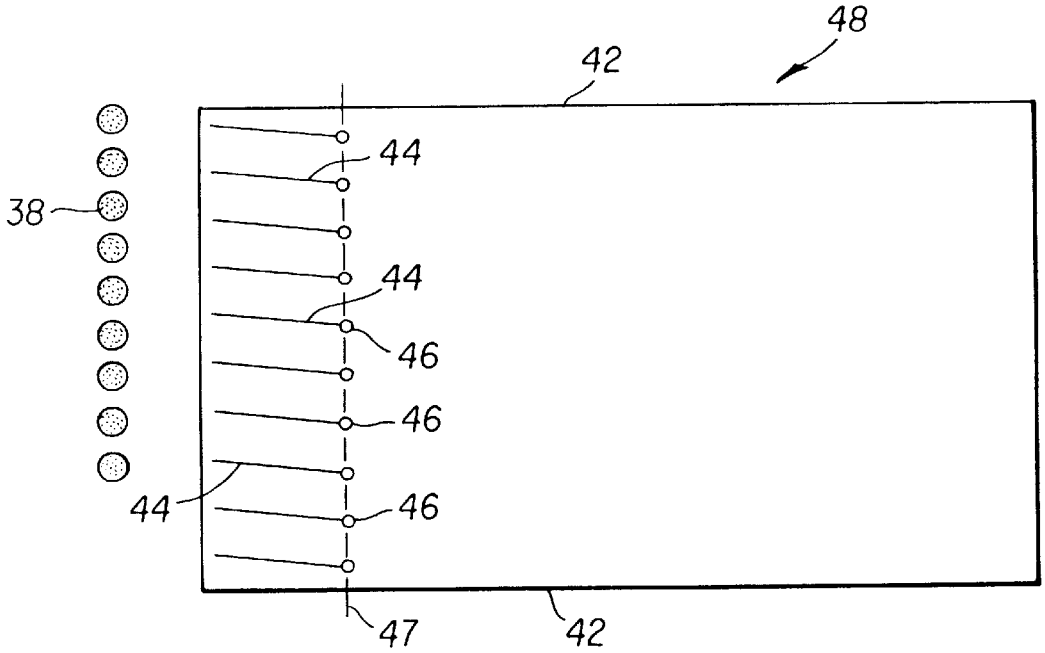

FIGS. 4*a* and 4*b* show a first embodiment implementing the present invention. A portion 48 of system 32 is configured with a plurality of control vanes 44 used to control the direction of force 30 in a first direction (aligned with edges 42 of system 32 as shown in FIG. 4*a*) and in a second direction (angled from edges 42 of system 32 as shown in FIG. 4*b*). Alignment of control vanes 44 in FIG. 4*a* is perpendicular to nozzle row 122 while alignment of control vanes 44 in FIG. 4*b* can vary but is generally not perpendicular. The resulting printed drops 38 in FIG. 4*b* are displaced along the direction of the nozzle row (in slow scan direction 132) due to alteration of the direction of force 30 caused by angling of control vanes 44. Control vanes 44 can be fabricated using known MEMS technology and techniques. Additionally control vanes 44 can be made from various known materials. For example, control vanes 44 can be made from small metallic pieces which are rotated about a common support point 46 located at an end of each control vane. A known controller can be used to angle control vanes 44 at an appropriate time with an appropriate amount of angle.

Figure 4C:
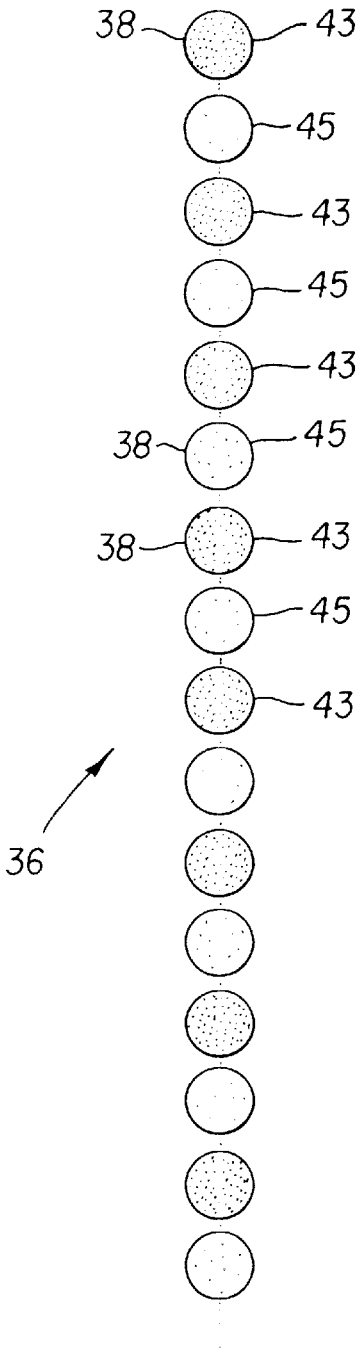
FIG. 4*c* shows a row of printed ink drops produced by the apparatus of FIGS. 4*a* and 4*b;*
Figure 4D:
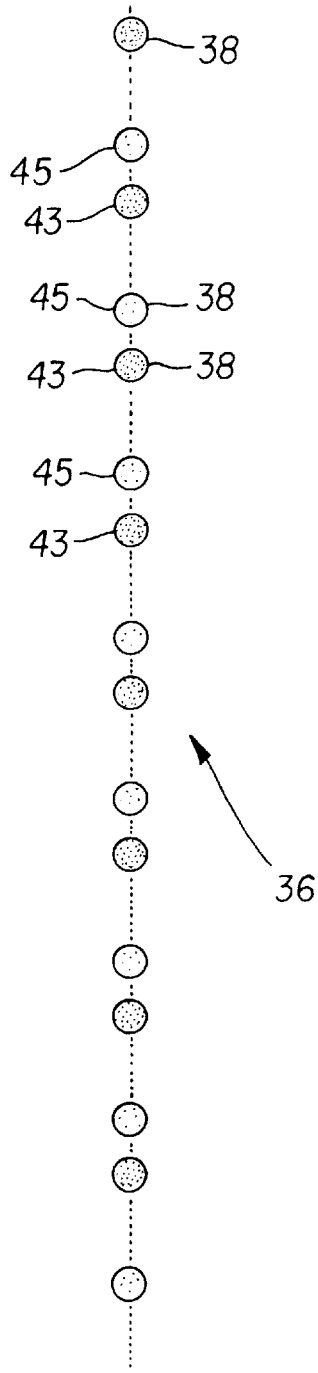
FIG. 4*d* shows a row of printed ink drops produced by the apparatus of FIGS. 4*a* and 4*b;*

By printing with subsequent scans of printhead 120 in fast scan direction 128, with each scan having an altered direction of force 30, resulting patterns 36 of printed ink drops 38 with displaced drops 43 and non-displaced drops 45, as shown in FIGS. 4*c* and 4*d*, can be accomplished without having to mechanically displace printhead or receiver. In FIG. 4*c*, ink drops 38 are displaced from one scan to another by one half the distance between nozzles. In FIG. 4*d*, ink drops 38 are displaced by a amount greater than one half the distance between nozzles. Typically, a useful displacement includes a multiple of a simple fraction of the distance between nozzles. For example, in FIG. 4*d*, ink drop displacement is two thirds the distance between nozzles such that subsequently displaced scans can "fill in" the scan line with additional evenly spaced ink drops. Useful displacement can also include a multiple of a simple fraction greater than one (for example, 5/4, etc.) and/or a multiple of a simple fraction less than one half (for example, 1/6, etc.) depending on the criteria for a particular situation. In these examples, the number of scans required to fill in a line with drops of regular spacing would be 4 and 6, respectively, as can be appreciated by one skilled in the inkjet printing art.

An inexpensive manufacturing method for making vanes 44 is electroforming a metal such as nickel, nickel-iron alloy, or the alloy known as permalloy, etc. into vane-shaped openings defined by an xray patterning of a thick polymer film, a technique known in the art of microfabrication as LIGA. Vanes 44 may be attached together by an electroformed bridge 47, sufficiently thin to flex so as to allow vanes 44 to be angled, at their top and bottom surfaces as shown at the top side of vanes 44 by dotted lines 47 in FIGS. 4*a* and 4*b*, so that all vanes 44 move together. The vanes 44 are made from a magnetic material such as permalloy, vanes 44 can be angled by application of a magnetic field from a magnet with poles spaced the same as vanes 44 and positioned above system portion 48 or at the sides of system portion 48 or bridge 47 near the front of system portion 48. Alternatively, vanes 44 can be contacted mechanically by an arm from a servo motor. The positions of the drops, either before or after printing, can be easily monitored with a CCD camera and vanes can be then adjusted by programming a controller in a feedback loop to alter the magnet field (or to actuate the servo motor) until the desired drop position is achieved. As can be appreciated by one skilled in mechanical design, many additional ways of fabricating vanes and actuating their motion are possible. For example, vanes 44 can be fabricated by injection molding vanes 44 from a conductive plastic material and controlling their position by electrostatic attraction to an additionally provided set of interleaved vanes in system portion 48, or by fabricating vanes 44 from a piezo material and electrifying that material to angle vanes 44.

Figure 5A:
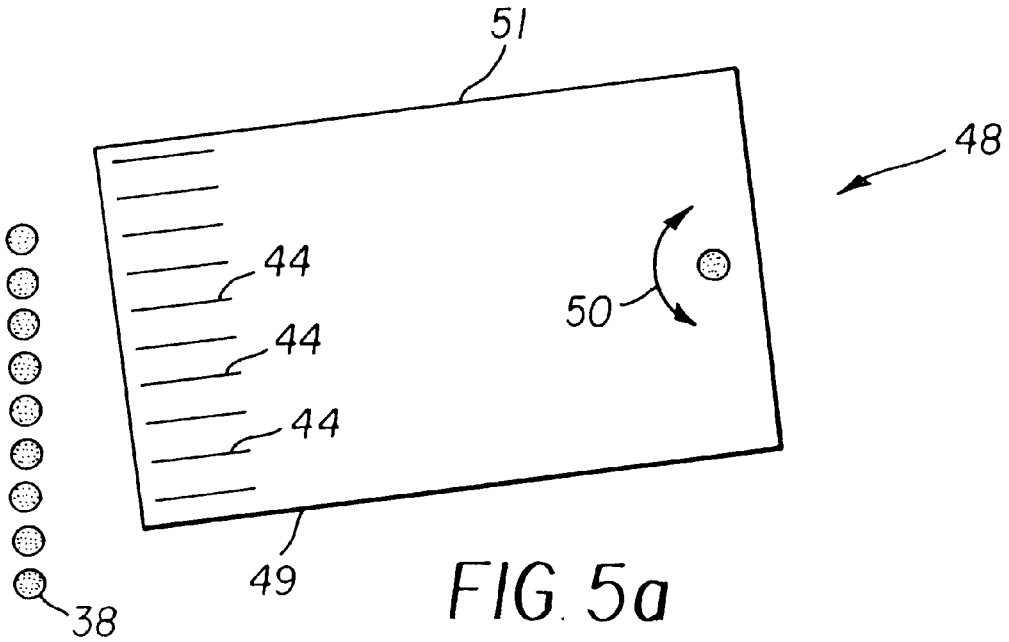
FIGS. 5*a* and 5*b* show schematic top views of alternative embodiments of the apparatus of FIGS. 4*a* and 4*b;*
Figure 5B:
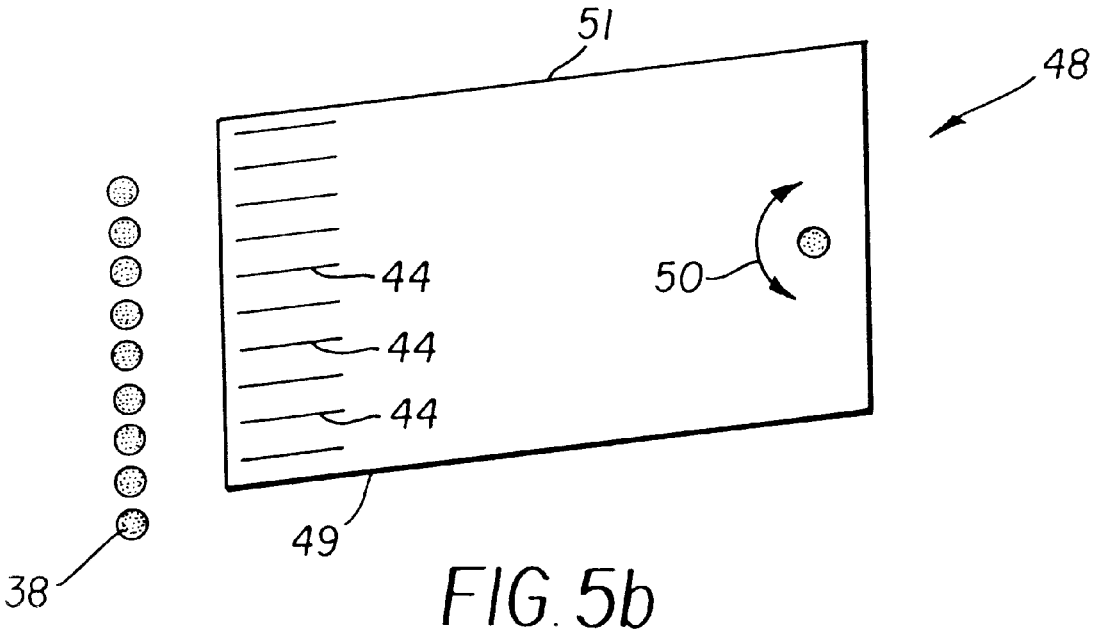

FIGS. 5*a* and 5*b* show a second and a third embodiment of the present invention. Again, control vanes 44 redirect force 30 in order to alter the position of printed ink drops. In these embodiments, at least a portion 48 of system 32 is aligned during one scan and angled with respect to fast scan direction during a subsequent scan. In FIG. 5*a*, portion 48 has a rectangular shape and is rotated (shown at 50) using any known devices and techniques relative to nozzle row 122. As portion 48 is rotated, the distance from ends of portion 48 relative to nozzles gradually changes causing displacement of printed ink drops. In FIG. 5*b*, portion 48 has a trapezoidal shape such that the distance from the ends of portion 48 to nozzle row remains constant along an end of portion 48. In practice, it has been discovered that the amount of deflection of printed ink drops is not very sensitive to (or dependent on) the distance of the ink drops from portion 48. For example, a change in the distance of ink drops from portion 48 of 1 mm results in a change in drop deflection of less than 20 microns after the drop has traversed interaction distance L of portion 48 (a vertical direction dimension of 1 mm in FIG. 2*a*). As such, trapezoidal shapes are required only when extremely accurate and very uniform ink drop translations are desired.

Portion 48 can be rotated by commercially available rotational servo motors based on signals provided from controller 134. Controller 134 can use a look-up table to determine the signal required for a given desired displacement of the printed drops or the positions of the drops, either before or after printing. This can be easily monitored with a CCD camera and the degree of rotation can be then adjusted by programming controller 134 in a feedback loop to alter signal to a servo motor until the desired drop position is achieved. If, as in FIG. 5*b*, system portion 48 is to be held parallel to nozzle row 122, a servo motor can be used to rotate the system portion 48 by rotating sidewalls 49, 51 of system portion 48, but side walls 49, 51 of system portion 48 should be free to slide mechanically on top and bottom surfaces of system portion 48. In this example, right end (as shown in FIG. 5*b*) of side walls 49, 51 should be located in a fixed position, and the top and bottom surfaces should be made to extend beyond sidewalls 49, 51 so that when sidewalls 49, 51 are angled and slide along the top and bottom airtube surfaces, sidewalls 49, 51 do not pass over the edges of the top and bottom surfaces of system portion 48.

Figure 6A:
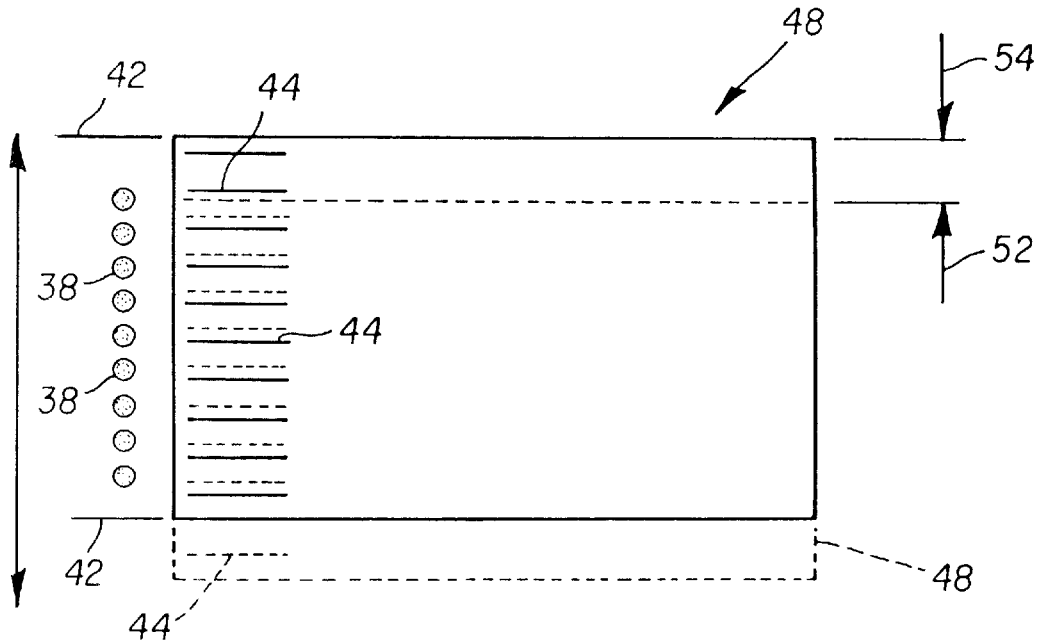
FIG. 6*a* shows a schematic top view of an alternative embodiment of the apparatus of FIGS. 4*a* and 4*b* translated between a first position and an offset second position.
Figure 6B:
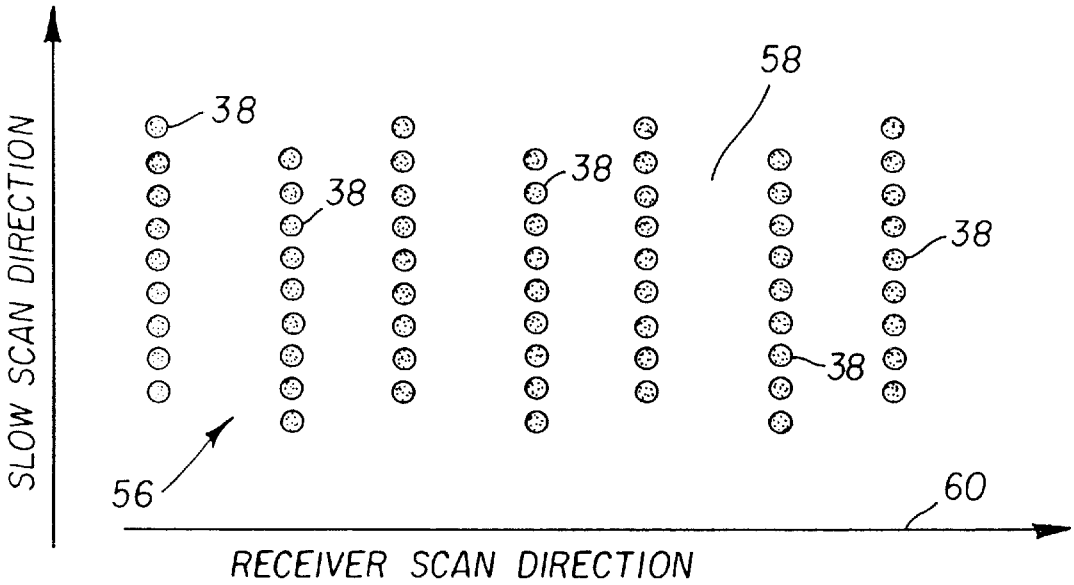
FIG. 6*b* shows a time history of the pattern of ink drops printed on a receiver for the printhead of FIG. 6*a;*

Referring to FIG. 6*a*, another embodiment of the present invention is shown. This embodiment is especially appropriate when rapid or periodic translation of printed drops in the slow scan direction is desired. In FIG. 6*a*, system portion 48 having control vanes 44 is displaced in alternating first (aligned 35 relative to fiducial lines 42) and second (offset relative to fiducial lines 42) directions 52, 54 (in a slow scan direction, etc.). This creates flow patterns in force 30 that translate printed ink drops 38 in directions corresponding to first and second directions. FIG. 6*b* shows lines 56 of ink drops 38 printed on a receiver 58 moving in a receiver scan direction 60 with the ink drops being ejected simultaneously from nozzles 16 in nozzle row 122 (of FIG. 2*b*). The line of printed ink drops is displaced in proportion to the speed of displacement of system portion 48 in slow scan direction. Displacement distance of printed ink drop corresponds to translation distance of system portion 48. However, translation of system portion 48 is such that system portion 48 does not overshoot nozzles 16 positioned at ends of nozzle row 62. As such, force 30 of system portion 48 does not miss ink drops ejected from nozzles 16 positioned at ends of nozzle row 122.

System portion 48 may be translated as shown in FIG. 6*b* by commercially available linear servo motors based on signals provided from controller 134. Controller can use a look-up table to determine the signals required for a given desired displacement of the printed drops or the positions of the drops, either before or after printing. This can be easily monitored with a CCD camera and the degree of translation can be then adjusted by programming controller 134 in a feedback loop to alter signal to the servo motor until the desired drop position is achieved.

The embodiments described above disclose apparatus and methods for translating a pattern of ink drops ejected from a nozzle row in a direction parallel to nozzle row 120 without moving printhead 120. It is also useful in inkjet printing to have precise control of ink drop line rotation of ink drops printed from a nozzle row with respect to an edge of a receiver. Controlling ink drop line rotation helps to correct for receiver alignment problems (relative to a printhead, etc.) and prevent image artifacts. Alignment problems include a receiver initially misaligned, becoming slightly misaligned during a fast scan or while being moved after a fast scan of a printhead, etc. Roll fed printers are particularly susceptible to slight angular misalignment of paper as it slides or moves over the printing region. Alignment problems are significant in the printing art, as the human eye is extremely sensitive to image artifacts arising from an angular rotation of rows of printed drops relative to an edge of a receiver.

Figure 1:
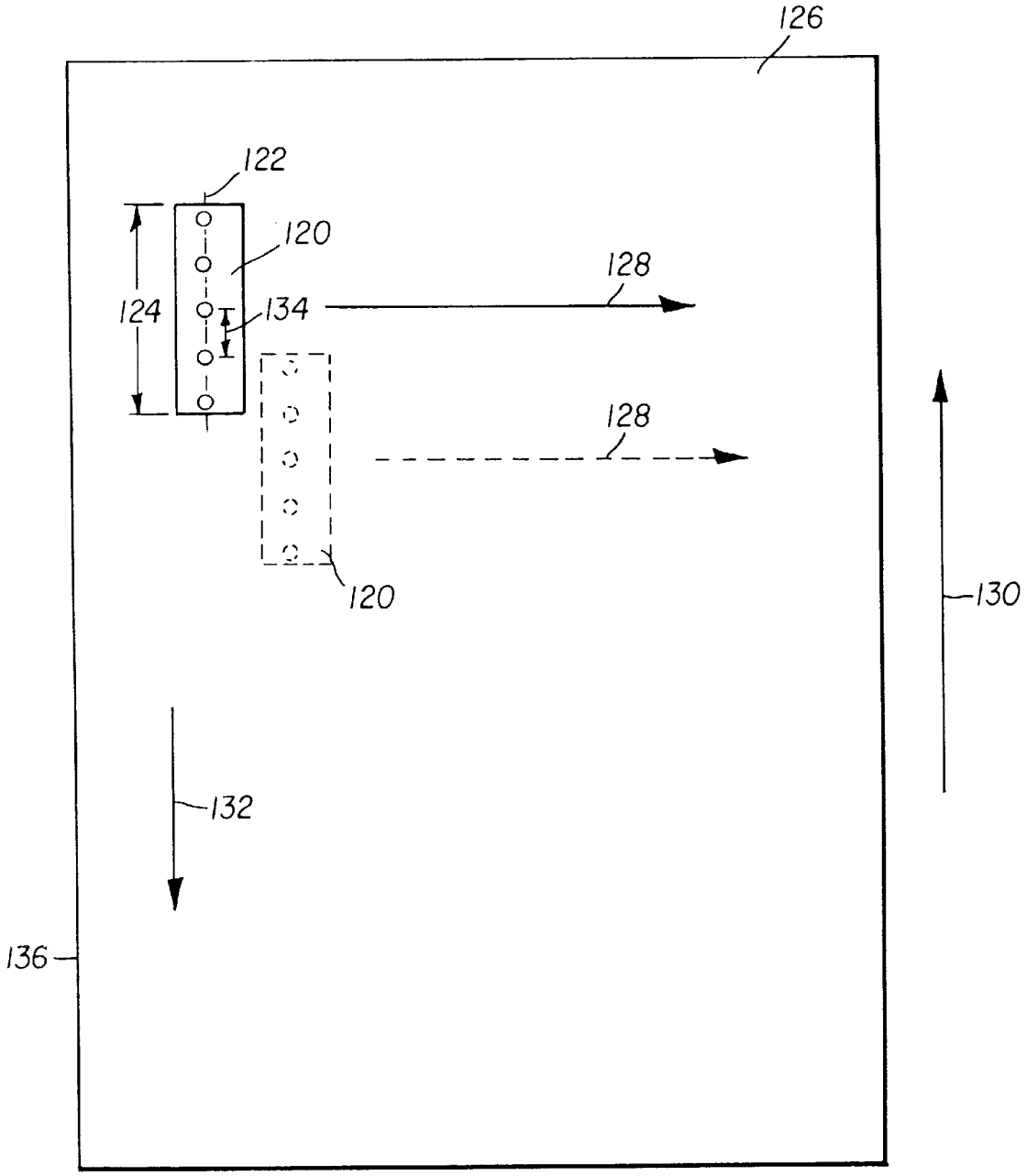
FIG. 1 (prior art)
FIG. 1 shows a prior art inkjet printhead being scanned over a receiver.
Figure 7B:
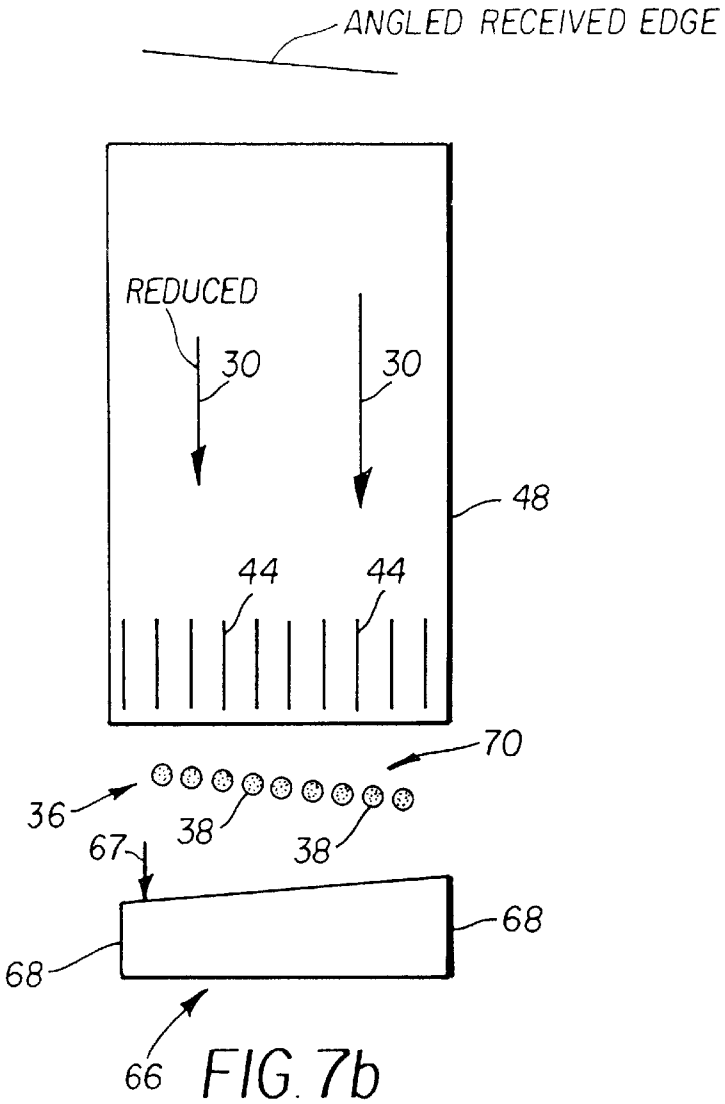
FIG. 7*b* shows a schematic top view and a cross-sectional view of the embodiment of FIG. 7*a* with the resulting pattern of printed ink drops.
Figure 7A:
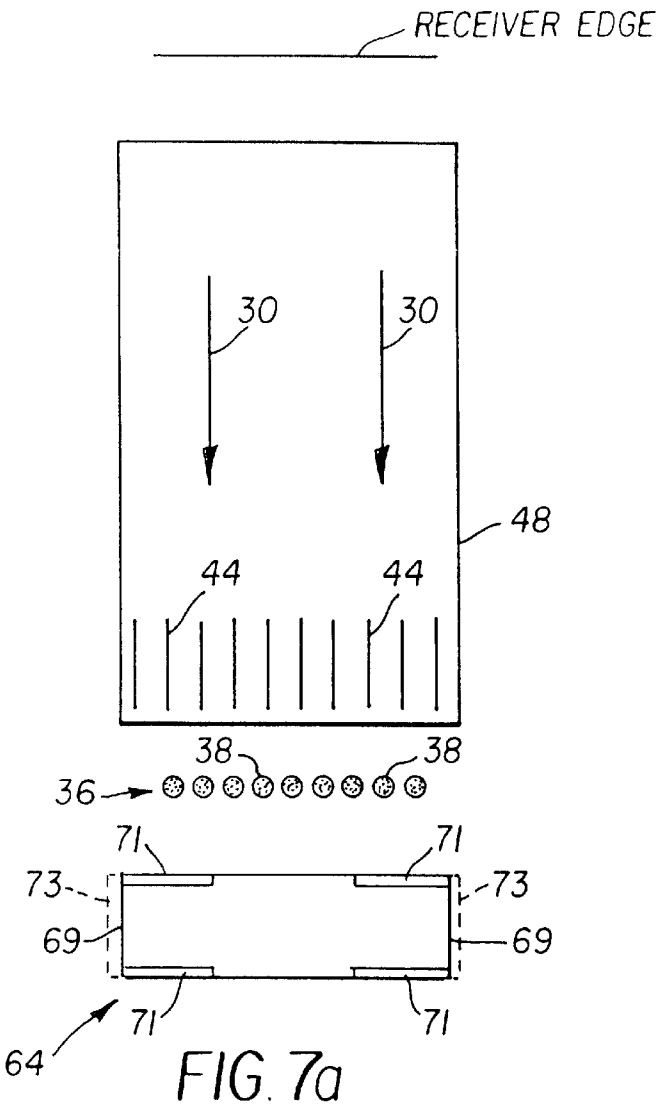
FIG. 7*a* shows a schematic top view and a cross-sectional view of an alternative embodiment of the apparatus of FIGS. 4*a* and 4*b* with the resulting pattern of printed ink drops.

Referring to FIG. 7*a*, a schematic top-view of system portion 48 and a pattern 36 of ink drops 38 printed on a receiver is shown. Typically, pattern 36 results when nozzles 16 in nozzle row 122 simultaneously eject printed drops. Printed drop pattern 36 is typically aligned perpendicularly to receiver edge 136 (shown in FIG. 1*a*) during printing. Receiver edges 136 can become misaligned (not aligned perpendicularly, angled, etc.). This can happen, for example, when there is a slight error in the direction of receiver motion which can occur in printers that periodically move the receiver (a roll-fed printers in which the receiver is unwound from a roll during printing, etc.).

Referring also to FIG. 7*b*, in order to compensate for the misalignment of a receiver edge, system portion 48 has been deformed mechanically from a rectangular cross-section 64 (FIG. 7*a*) to a trapezoidal cross-section 66. Deformation can be accomplished by applying a mechanical force 67 to system portion 48 with an elastic side member(s) 68. Deforming system portion 48 reduces flow of force 30 causing less deflection of ink drops. As shown in FIG. 7*b*, left side of system portion 48 has been deformed. As such, printed drops 38 on left side are deflected to a lesser degree (shown generally at 70) as force 30 is also reduced. The ink drop deflection reduction gradually decreases for drops ejected from nozzles positioned toward a right side of nozzle row because force 30 remains substantially constant (shown generally at 70) on right side of system portion 48. The resulting printed pattern 36 of ink drops is rotated through a slight angle. Alternatively, ink drop rotation can be from right to left. The exact amount and shape of deformation of system portion 48 can be selected such that the printed ink drops are precisely aligned to the misaligned or angled receiver. Typically, the exact deformation is calculated using computational modeling of force 30 as known to one of ordinary skill in the inkjet printing art. As such, rotational alignment of printed ink drops relative to a receiver edge is accomplished without rotating either the printhead or the receiver.

System portion 48 may be constructed of side members 69 which are shaped in the form of a bellows having corregations (shown in FIG. 7*a*) that is easily compressed when a downward force is applied. Such a force may be provided by planar magnetic coils 71 attached to the inside top of system portion 48 near the side to be compressed and positioned directly over a similar set of planar magnetic coils attached to the inside bottom of system portion 48. A current may be passed through both sets of coils from controller 134 to pull down the top surface of the airtube magnetically. Controller 48 can use a look-up table to determine the current required for a given desired displacement of printed drops 38 or the positions of the drops, either before or after printing. This can be easily monitored with a CCD camera and the degree of translation can be then adjusted by programming controller 134 in a feedback loop to alter the current until the desired drop position is achieved. Alternatively, a second bellows sidewall 73 can be positioned very near the first (dotted line in FIG. 7*a*), the open end between sidewalls 69 and 73 being sealed to air using a flexible material like latex, and a vacuum applied to the space between bellows sidewall 69, 73 to collapse the bellows and compress system portion 48.

Figure 7E:
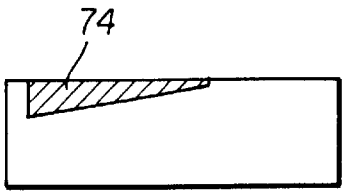
FIG. 7*e* shows a cross-sectional view of an alternative embodiment of FIG. 7*d;*
Figure 7D:
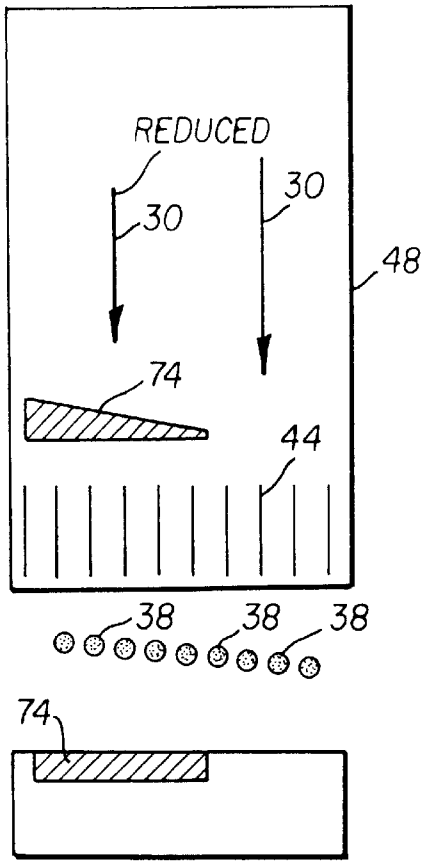
FIG. 7*d* shows a schematic top view and a cross-sectional view of an alternative deflector system of FIG. 7*a* with the resulting pattern of printed ink drops.
Figure 7C:
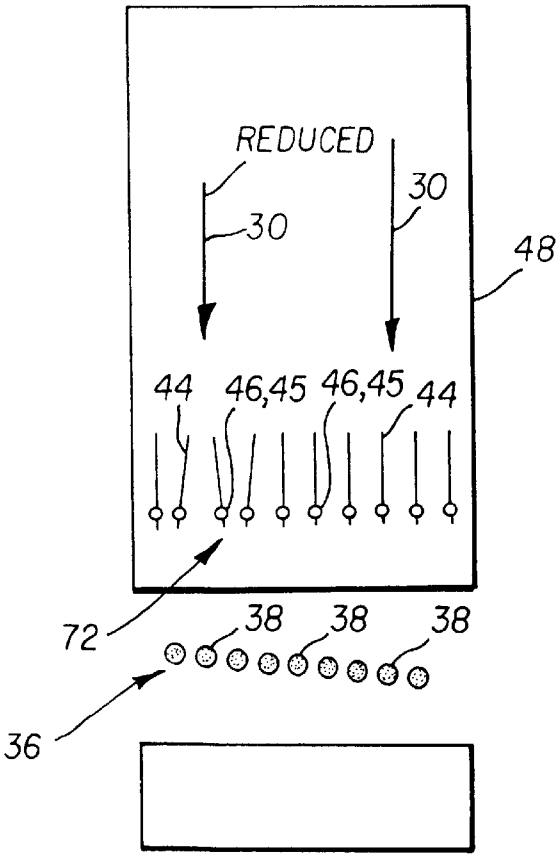
FIG. 7*c* shows a schematic top view and a cross-sectional view of an alternative embodiment of FIG. 7*c* with the resulting pattern of printed ink drops.

FIG. 7*c* shows a second embodiment of the invention shown in FIGS. 7*a* and 7*b*. In FIG. 7*c*, force 30 is reduced on left side of system portion 48 by changing the angle 72 between members of pairs of control vanes 44 so as to increase resistance to flow of force 30. Control vanes 44 can be constructed using known MEMS techniques from small metallic pieces which are rotated about a common support point 46. As flow of force 30 is reduced on left side of system portion 48, printed ink drops 38 corresponding to left side are deflected to a lesser degree than on right side. Alternatively, ink drop rotation can be from right to left. As such, the printed pattern 36 of drops is rotated through an angle without moving the printhead or the receiver.

Vanes 44 may be fabricated by injection molding each of vanes 44 from a conductive plastic material, the mold including a rod portion 45 running vertically through vane 44 and extending above the top and bottom of the vane, the location of the rod being shown at 45 in the top view of vanes 44 in FIG. 7*c*. Rod 45 is located away from vane center so that electrostatic forces to be described cause selected rotation of the vanes. Rods 45 of each vane 44 are cemented into locating holes in the top and bottom of system portion 48 to that vane 44 rotates on the rod 45 by twisting it. Each vane 44 is contacted electrically at the locating holes by a thin film conductor patterned on the top or bottom system portion 48. Controller 134 is programmed to apply a selectable control voltages to each vane 44 and to thereby control pairwise the angular positions of vanes 44 by electrostatic attraction. A typical control voltage pattern on the vanes 45 can be positive and negative voltages for vane positions shown in FIG. 7*c*. As can be appreciated by one skilled in electrostatics, electrostatic attractive forces occur for oppositely charged vanes whereas no forces occur pairwise between similarly charged vanes. Controller 134 can use a look-up table to determine the voltages required for a given desired angulation of vanes 44; or the positions of the drops, either before or after printing. This can be monitored with a CCD camera and the degree of angulation can be then adjusted by programming controller 134 in a feedback loop to alter magnitude of the voltages applied to vanes 44.

FIGS. 7*d* and 7*e* show additional embodiments of the invention shown in FIGS. 7*a* and 7*b*. In FIGS. 7*d* and 7*e* force 30 is reduced by positioning a shaped restrictor 74 (rectangular in FIG. 7*d*, trapezoidal in FIG. 7*e*). Restrictor 74 increases resistance force 30 in proportion to its degree of penetration into the flow of force 30 and to its length along the direction of flow. Restrictor 74 can be a mechanically moved block, nominally positioned relative to system portion 48 (in a recessed area of portion 48, etc.) and moved down into the flow of force 30 when rotation of a printed drop pattern is desired. A top view of restrictor 74, shown in FIG. 7*d*, is preferably trapezoidal helping to further reduce flow of force 30. Additionally, a top view of restrictor 74, shown in FIG. 7*e*, is preferably rectangular so as not to reduce flow of force 30 too much. As flow of force 30 is reduced on left side of system portion 48, printed ink drops corresponding to left side are deflected to a lesser degree than on right side. Alternatively, rotation can be from right to left. As such, the printed pattern of drops is rotated through an angle without moving the printhead or the receiver.

Airflow restrictor 74 is conveniently made from an elastic membrane affixed at its edges to the top inner surface of system portion 48. A membrane of restrictor 74 may be inflated pneumatically by connecting it pneumatically to a narrow tube running along the top inner surface of system portion 48 and exiting system portion 48 through its top surface at a location chosen to prevent mechanical interference with system portion 48 supports or with a receiver. The narrow tube is connected to a pneumatic source through valves which can be opened and closed by controller 134. When inflated, the shape of restrictor 74 is determined by the air pressure and by the distance of the elastic membrane from any point on its surface that is affixed to the top inner surface of system portion 48. A membrane which is rectangular in top view and which is affixed to the inner top surface of system portion 48 only around its perimeter will inflate as shown in FIG. 7*d*. A restrictor 74 whose top view is trapezoidal will inflate as shown in FIG. 7*e*. Controller 134 can use a look-up table to determine the valve openings required for a given desired displacement of the printed drops; or the positions of the drops, either before or after printing. The degree of translation can be then adjusted by programming controller 134 in a feedback loop.

Figure 7F:
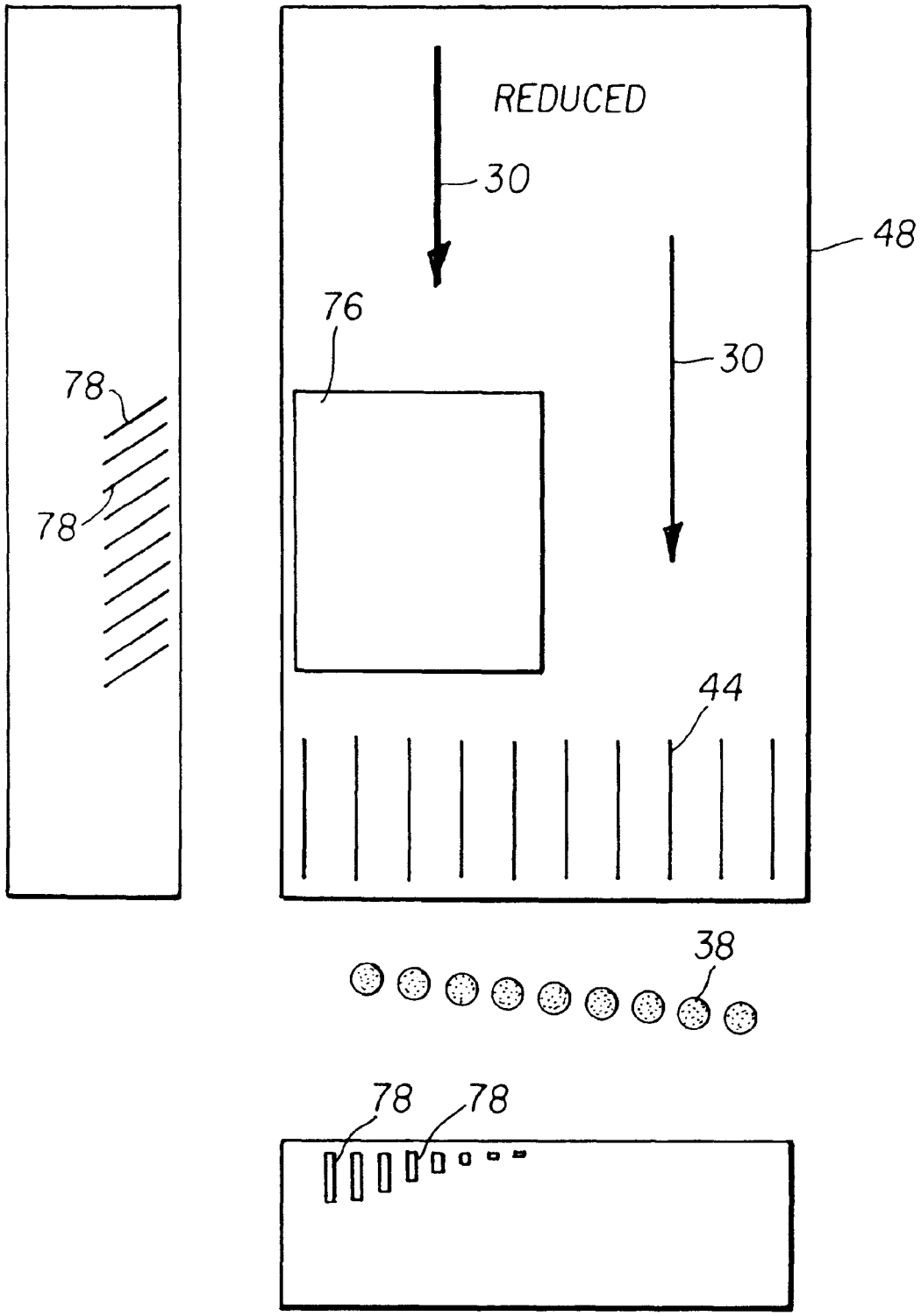
FIG. 7*f* shows a schematic top view, a side view, and an end cross-sectional view of an alternative embodiment of FIG. 7*a* with the resulting pattern of printed ink drops.
Figure 7G:
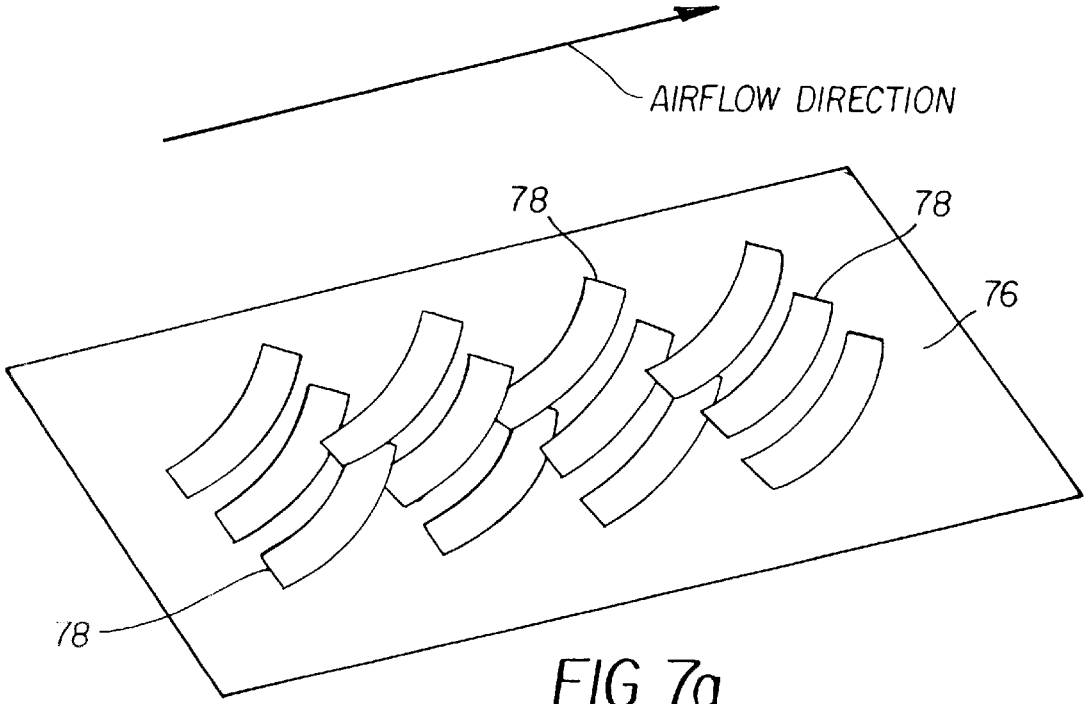
FIG. 7*g* shows a control surface for the embodiment shown in FIG. 7*f.*

FIGS. 7*f* and 7*g* show another embodiment of the invention shown in FIGS. 7*a* and 7*b*. In FIG. 7*f*, flow of force 30 is reduced by positioning a control mechanism 76 such that control mechanism 76 interacts with force 30. Control mechanism 76 has at least one adjustable cantilever 78 (as shown in FIG. 7*g*). Each cantilever 78 can be individually extended (bent, pushed, etc.) into force 30 thereby restricting flow depending on the degree of penetration of each cantilever 78 and the length of control mechanism 76 along the direction of flow of force 30. Control mechanism 76 can be constructed using MEMS techniques well known to those skilled in the art. For example, control mechanism 76 can incorporate an electrical conductor and each cantilever 78 can be aluminum thin films patterned photolithographically into long, thin plates that are electrostatically attracted by application of a voltage to cantilevers 78. When no voltage is present, each cantilevers 78 can be designed to have internal stresses causing them to extend away from control mechanism 76. Alternatively, each cantilever 78 can be bimetallic strips which curl up when heated by an electric current passed through the strip or along its length. This is also well known to one of ordinary skill in the art. Typically, control mechanism 76 shown in FIG. 7*d* is rectangular as viewed from a top view. However, control mechanism 76 is not required to be rectangular as long as cantilevers 78 are individually controlled. As flow of force 30 is reduced on left side of system portion 48, printed ink drops corresponding to left side are deflected to a lesser degree than on right side. As such, the printed pattern of drops is rotated through an angle without moving the printhead or the receiver.

A voltage applied to a particular cantilever 78 will cause that cantilever 78 to move from a contracted to an extended state. To control airflow through system portion 48 in accordance with the present invention, the position of each cantilever 78 on control mechanism 76 is adjusted by applying a plurality of voltage signals from controller 134. The voltages being conveyed to control mechanism 76 through a plurality of electrical leads which may be fabricated on the inner top surface of system portion 48 which extend along the inner top surface and exit system portion 48 in order to connect to controller 134 through the top surface at a location chosen to prevent mechanical interference of the leads with system portion 48 supports or the receiver.

Due to the small size of cantilevers 78, there is a need to have very many of them to effectively control force 30. As such, there is a need to provide many, for example a hundred or more, electrical leads. Control mechanism 76 can be attached to these electrical leads within system portion 48 by techniques such as bump bonding, known in the art of semiconductor package fabrication. Controller 134 can use a look-up table to determine the values of the voltages required to achieve force 30 control sufficient to provide a desired displacement of the printed drops. Alternatively, the positions of the drops, either before or after printing, can be easily monitored with a CCD camera and the degree of rotation can be then adjusted by programming controller 134 in a feedback loop to alter the voltages applied to the cantilevers and hence the positions of the cantilevers until the desired drop position is achieved. It is possible to control the flow of force 30 in system portion 48 to a very high degree of accuracy due to the large number of voltage output from controller 134.

The invention has been described in detail with particular reference to certain preferred embodiments thereof, but it will be understood that variations and modifications can be effected within the spirit and scope of the invention.

What is claimed is:

1. A continuous ink jet printing apparatus comprising:

a nozzle array, portions of the nozzle array defining a length dimension;

a drop forming mechanism positioned relative to the nozzle array, the drop forming mechanisnm being operable in a first state to form ink drops having a first volume travelling along a path and in a second state to form ink drops having a second volume travelling along the path; and a system which applies force to the ink drops travelling along the path, the force being applied in a direction such that the ink drops having the first volume diverge from the path, wherein at least a portion of the system is configured to displace the ink drops having the first volume relative to the length dimension of the nozzle array.

2. The apparatus according to claim 1, wherein the system portion is moveably positioned relative to the nozzle array such that the ink drops having the first volume are displaced relative to the length dimension of the nozzle array.

3. The apparatus according to claim 2, wherein the system portion is rotatably positioned relative to the nozzle array.

4. The apparatus according to claim 2, wherein the system portion includes at least one control vane rotatably positioned relative to the nozzle array.

5. The apparatus according to claim 4, wherein the at least one control vane is pivotably attached to the system portion.

6. The apparatus according to claim 5, wherein the at least one control vane has an end, the at least one control vane being pivotably attached to the system portion at the end.

7. The apparatus according to claim 1, wherein the system applies the force in the direction such that the ink drops having the second volume remain travelling substantially along the path, the ink drops having the second volume being displaced relative to the length dimension of the nozzle array.

8. The apparatus according to claim 1, further comprising:

a gutter shaped to collect the ink drops having one of the first volume and the second volume, the gutter being positioned substantially along one of a diverging path and the path.

9. The apparatus according to claim 1, wherein the system portion is configured to apply the force in a first direction relative to the length dimension of the nozzle array and apply the force in a second direction relative to the length dimension of the nozzle array.

10. The apparatus according to claim 9, wherein the first direction is substantially perpendicular to the length dimension of the nozzle array.

11. The apparatus according to claim 9, wherein the second direction is other than substantially perpendicular to the length dimension of the nozzle array.

12. The apparatus according to claim 1, wherein the drop forming mechanism includes a heater.

13. The apparatus according to claim 1, wherein the force includes a gas flow.

14. A method of translating ink drops ejected from a continuous ink jet printhead comprising:

forming a first ink drop having a first volume travelling along a path;

forming a first ink drop having a second volume travelling along the path;

causing the first ink drop having the first volume to diverge from the path by applying a force in a first direction along the path;

forming a second ink drop having the first volume travelling along the path;

forming a second ink drop having the second volume travelling along the path; and causing the second ink drop having the first volume to diverge from the path displaced relative to the first ink drop having the first volume by applying the force in a second direction along the path.

15. The method according to claim 14, further comprising:

preventing the first and second ink drops having the second volume from impinging on a recording medium.

16. The method according to claim 14, further comprising:

causing the first and second ink drops having the first volume to impinge on a recording medium.

17. A method of translating ink drops comprising:

forming a first ink drop having a first volume travelling along a path;

causing the first ink drop having the first volume to diverge from the path by applying a force in a first direction along the path;

forming a second ink drop having the first volume travelling along the path; and causing the second ink drop having the first volume to diverge from the path displaced relative to the first ink drop having the first volume by applying the force in a second direction along the path.

18. The method according to claim 17, further comprising:

forming a first ink drop having a second volume travelling along the path;

forming a second ink drop having the second volume travelling along the path; and causing the second ink drop having the second volume to become displaced relative to the first ink drop having the second volume as the first and second ink drops having the second volume continue travelling substantially along the path.

19. The method according to claim 17, further comprising:

forming a first ink drop having a second volume travelling along the path, forming a second ink drop having the second volume travelling along the path; and causing the first ink drop having the second volume and the second ink drop having the second volume to diverge from the path, the second ink drop having the second volume being displaced relative to the first ink drop having the second volume.

20. The method according to claim 17, wherein the first ink drop and the second ink drop are formed using heat.

21. The method according to claim 17, wherein the first direction is substantially perpendicular to the path.

22. The method according to claim 17, wherein the second direction is substantially perpendicular to the path and at an angle relative to the first direction.

23. The method according to claim 17, wherein the force is a gas flow.

24. A continuous ink jet printing apparatus comprising:

a nozzle array;

a drop forming mechanism positioned relative to the nozzle array, the drop forming mechanism being operable to form a first ink drop travelling along a path and a second ink drop travelling along the path; and a system which applies force to the first and second ink drops travelling along the path, the force being applied in a direction such that the first and second ink drops diverge from the path, at least a portion of the system being moveable between a first position relative to the nozzle array and a second position relative to the nozzle array such that the second ink drop is displaced relative to the first ink drop as the second ink drop diverges from the path.

25. The apparatus according to claim 24, portions of the nozzle array defining a length dimension, wherein the displacement of the second ink drop relative to the first ink drop is along the length dimension.

26. The apparatus according to claim 24, portions of the nozzle array defining a length dimension, wherein the first position of the system portion is substantially perpendicular to the length dimension of the nozzle array.

27. The apparatus according to claim 24, portions of the nozzle array defining a length dimension, wherein the second position of the system portion is at an angle relative to the length dimension of the nozzle array.

28. The apparatus according to claim 24, wherein the system portion is rotatably positioned relative to the nozzle array.

29. The apparatus according to claim 24, wherein the system portion includes at least one control vane rotatably positioned relative to the nozzle array.

30. The apparatus according to claim 29, wherein the at least one control vane is pivotably attached to the system portion.

31. The apparatus according to claim 30, the at least one control vane having an end, wherein the at least one control vane is pivotably attached to the system portion at the end.

32. The apparatus according to claim 24, the drop forming mechanism being operable in a first state to form the first and second ink drops, the first and second ink drops having a first volume, wherein the drop forming mechanism is operable in a second state to form first and second ink drops having a second volume travelling along said path, the force being applied in a direction such that the first and second ink drops having the second volume remain travelling substantially along the path.

33. The apparatus according to claim 32, further comprising:

a gutter shaped to collect the first and second ink drops having the second volume, the gutter being positioned substantially along the path.

34. The apparatus according to claim 32, wherein the second ink drop having the second volume is displaced relative to the first ink drop having the second volume.

35. A continuous ink jet printing apparatus comprising:

a nozzle array, portions of the nozzle array defining a length dimension;

a drop forming mechanism positioned relative to the nozzle array, the drop forming mechanism being operable in a first state to form ink drops having a first volume travelling along a path and in a second state to form ink drops having a second volume travelling along the path; and a system which applies force to the ink drops travelling along the path, the force being applied in a direction such that the ink drops having the first volume diverge from the path, the ink drops having the first volume being displaced relative to each other along the length dimension, wherein at least a portion of the system includes at least one control vane rotatably positioned relative to the nozzle array.

36. The apparatus according to claim 35, wherein the at least one control vane is pivotably attached to the system portion.

37. The apparatus according to claim 36, wherein the at least one control vane has an end, the at least one control vane being pivotably attached to the system portion at the end.

38. A continuous inkjet printing apparatus comprising:

a nozzle array;

a drop forming mechanism positioned relative to the nozzle array, the drop forming mechanism being operable to form a first ink drop travelling along a path and a second ink drop travelling along the path; and a system which applies force to the first and second ink drops travelling along the path, the force being applied in a direction such that the first and second ink drops diverge from the path, at least a portion of the system being moveable between a first position relative to the nozzle array and a second position relative to the nozzle array such that the second ink drop is displaced relative to the first ink drop as the second ink drop diverges from the path, wherein the system portion includes at least one control vane rotatably positioned relative to the nozzle array.

39. The apparatus according to claim 38, wherein the at least one control vane is pivotably attached to the system portion.

40. The apparatus according to claim 39, wherein the at least one control vane has an end, the at least one control vane being pivotably attached to the system portion at the end.

* * * * *